US010253660B2

(12) United States Patent
Niekamp et al.

(10) Patent No.: US 10,253,660 B2
(45) Date of Patent: Apr. 9, 2019

(54) VALVE TRAIN FOR AN INTERNAL COMBUSTION ENGINE

(71) Applicant: Mahle International GmbH, Stuttgart (DE)

(72) Inventors: Peer Niekamp, Leutenbach (DE); Edgar Salfeld, Lichtenwald (DE)

(73) Assignee: Mahle International GmbH (DE)

( * ) Notice: Subject to any disclaimer, the term of this patent is extended or adjusted under 35 U.S.C. 154(b) by 98 days.

(21) Appl. No.: 15/628,382

(22) Filed: Jun. 20, 2017

(65) Prior Publication Data

US 2017/0362970 A1 Dec. 21, 2017

(30) Foreign Application Priority Data

Jun. 20, 2016 (DE) ..... 10 2016 210 976

(51) Int. Cl.
*F01L 13/00* (2006.01)
*F01L 1/053* (2006.01)
(Continued)

(52) U.S. Cl.
CPC ..... *F01L 13/0063* (2013.01); *F01L 1/0532* (2013.01); *F01L 1/185* (2013.01);
(Continued)

(58) Field of Classification Search
CPC ..... F01L 2001/0473; F01L 1/18; F01L 1/46; F01L 13/0063; F01L 2105/00; F01L 2820/032
(Continued)

(56) References Cited

U.S. PATENT DOCUMENTS

2010/0077979 A1* 4/2010 Takada ..... F01L 1/18 123/90.16
2012/0138002 A1* 6/2012 Tsuzuki ..... F01L 1/185 123/90.18
(Continued)

FOREIGN PATENT DOCUMENTS

DE 19945340 A1 3/2001
DE 102007024598 A1 11/2008
(Continued)

OTHER PUBLICATIONS

English abstract for DE-19945340.
(Continued)

*Primary Examiner* — Jorge Leon, Jr.
(74) *Attorney, Agent, or Firm* — Fishman Stewart PLLC

(57) ABSTRACT

A valve train may include a camshaft having first and second slide guides, first and second cams mounted axially adjacent in torque-proof manners on the camshaft, and a cam follower adjustable between a first position, in which the cam follower is drivingly connected with the first cam, and a second position, in which the cam follower is drivingly connected with the second cam. The valve train may also include an adjustment arrangement having adjustable mechanical first and second engagement elements for axially adjusting the cam follower between first and second positions. Each engagement element may be adjustable between basic positions, in which no contact exists with a respective one of the slide guides, and switching positions, in which the respective engagement element cooperates with the slide guide. Each engagement element may have a spring that prestresses it into the switching position. The valve train may further include an arresting device and an actuator for each engagement element, wherein the arresting device, when in a locked position, holds the associated engagement
(Continued)

element in the basic position, and the actuator releases the arresting device.

19 Claims, 2 Drawing Sheets

(51) Int. Cl.
*F01L 1/18* (2006.01)
*F01L 1/46* (2006.01)
*F01L 1/047* (2006.01)

(52) U.S. Cl.
CPC ..... *F01L 13/0036* (2013.01); *F01L 1/46* (2013.01); *F01L 2001/0473* (2013.01); *F01L 2001/0478* (2013.01); *F01L 2013/0052* (2013.01); *F01L 2013/101* (2013.01); *F01L 2105/00* (2013.01); *F01L 2820/032* (2013.01)

(58) Field of Classification Search
USPC ..... 123/90.17, 90.18, 90.2, 90.32, 90.44
See application file for complete search history.

(56) References Cited

U.S. PATENT DOCUMENTS

| | | | | |
|---|---|---|---|---|
| 2012/0235777 | A1 | 9/2012 | Elendt et al. | |
| 2013/0118427 | A1 | 5/2013 | Elendt et al. | |
| 2013/0276564 | A1 | 10/2013 | Popp et al. | |
| 2015/0101552 | A1* | 4/2015 | Choi ..... | F01L 13/0036 123/90.15 |

FOREIGN PATENT DOCUMENTS

| | | | |
|---|---|---|---|
| DE | 102008060166 | A1 | 6/2010 |
| DE | 102010012471 | A1 | 9/2011 |
| DE | 102011086233 | A1 | 5/2013 |
| DE | 102012206569 | A1 | 10/2013 |
| JP | 2014-20260 | A | 2/2014 |

OTHER PUBLICATIONS

English abstract for DE-102010012471.
English abstract for DE-102008060166.
English abstract for DE-102007024598.
English abstract JP-2014-20260.

* cited by examiner

VALVE TRAIN FOR AN INTERNAL COMBUSTION ENGINE

CROSS-REFERENCE TO RELATED APPLICATIONS

This application claims priority to German Patent Application No. 10 2016 210 976.6 filed on Jun. 20, 2016, the contents of which is hereby incorporated by reference in its entirety.

TECHNICAL FIELD

The present invention relates to a valve train for an internal combustion engine with a camshaft and with a cam follower according to the introductory clause of claim 1. The invention additionally relates to an internal combustion engine with such a valve train.

BACKGROUND

From DE 199 45 340 A1 a generic valve train is known for an internal combustion engine with a camshaft and with a cam follower, wherein in a torque-proof manner on the camshaft first and axially adjacent thereto second cams are arranged. The cam follower itself is axially adjustable here between a first position, in which it is connected with the first cam, and a second position, in which it is connected with the second cam.

By means of an adjustable, conventional valve train, which comprises two cams of different cam stroke, the cylinder of an internal combustion engine can be operated in two different operating modes. If, instead of two cams of different stroke, only one single cam, and instead of a second cam, a base circle without cam stroke is used, then the associated cylinder can be disconnected by means of the valve train. In such a disconnected state, a cam follower, coupled to a gas exchange valve of the cylinder, cooperates only with the cam with said base circle, so that the gas exchange valve is not actuated.

In the valve trains known from the prior art, in particular their complex and therefore also expensive adjustment arrangements, which in addition have comparatively long response times, are generally disadvantageous.

The present invention is therefore concerned with the problem of indicating for a valve train of the generic type an improved or at least an alternative embodiment, which is distinguished in particular by a short response time.

This problem is solved according to the invention by the subject of the independent claim 1. Advantageous embodiments are the subject of the dependent claims.

SUMMARY

The present invention is based on the general idea of using spring-loaded engagement elements for controlling an adjustment arrangement of a valve train according to the invention, which engagement elements, when a wish for adjustment is present, merely have to be unlocked and thereby become effective abruptly. The valve train according to the invention for an internal combustion engine has here in a known manner a camshaft and a cam follower with a first cam applied in a torque-proof manner on the camshaft, and with a second cam arranged in a torque-proof manner and axially adjacent to the first cam. The cam follower is axially adjustable here in a known manner between a first position, in which it is drivingly connected with the first cam, and a second position, in which it is drivingly connected with the second cam. An adjustment arrangement is now provided according to the invention for the axial adjustment of the cam follower between the first and second position, which adjustment arrangement has an adjustable first mechanical engagement element, which for the axial adjusting of the cam follower from the first into the second position cooperates with at least a first slide guide present on the camshaft, and which has an adjustable second mechanical engagement element, which for the axial re-adjusting of the cam follower from the second into the first position cooperates with at least a second slide guide present on the camshaft. The first and the second engagement element are adjustable here respectively between a basic position, in which no contact exists with the associated slide guide, and a switching position, in which the respective engagement element cooperates with the associated slide guide. Each engagement element has here a spring which it prestresses into its switching position. Furthermore, an arresting device is provided, which locks the associated engagement element in a locked position and thereby holds it in its basic position. To release the arresting device, according to the invention an associated actuator is provided. If therefore an adjustment of the cam follower and thereby a change to the valve opening times is desired, this requires exclusively an activating of the actuator, whereupon the latter releases the arresting device and thereby cancels a locked position, in which the associated engagement element is held in its basic position, i.e. in the position not cooperating with the associated slide guide. By the unlocking of the arresting device, the spring associated with the respective engagement element brings about an abrupt adjusting of the engagement element from its basic position into its switching position, whereupon it abruptly cooperates with the associated slide guide on the camshaft and brings about an axial adjustment of the cam follower, for example of a roller picking up a cam profile. A re-tensioning of the spring and thereby a returning of the respective engagement element into its basic position, can be achieved here via a corresponding ramp contour in the associated slide guide, which will be described in further detail below. With the valve train according to the invention it is therefore possible for the first time to bring about a connecting of the engagement elements and therefore also of the adjustment arrangement, which is extremely efficient, because it is particularly abrupt, wherein for this exclusively the simplest components, such as for example the mentioned springs and the associated arresting devices or respectively actuators are necessary. In particular, a complex and therefore also expensive hydraulic adjustment arrangement can be dispensed with entirely. The adjustment arrangement according to the invention, however, not only involves the advantage of the rapid connection, but the actuator required for this can also be extremely small, owing to its function of only cancelling the locked state of the arresting device, and can thereby be produced in an optimized manner with regard to installation space, and at the same time at a favourable cost.

In an advantageous further development of the solution according to the invention, the arresting device has a locking element, in particular a locking catch or a locking pin, which in the locked position cooperates with an associated locking contour on the engagement element, in particular a groove or a wedge-shaped ramp. Such a locking element is preferably arranged here perpendicularly to the axis of the engagement element and therefore also perpendicularly to the adjustment direction of the respective engagement element, so that in the locked state it has to receive exclusively shear forces. For this reason, a particularly simple and small actuator can be used for cancelling the locked state.

In a further advantageous embodiment of the solution according to the invention, the arresting device is prestressed into its locked position by means of a spring. In this case, it therefore requires an actuator which overcomes this locked position in opposition to the spring force. When the actuator is not actuated, for example is not energized, then the arresting device moves respectively automatically into its locked position.

Expediently, the actuator is configured as an electric actuator, in particular as an electromagnet, as a hydraulic actuator or else as a pneumatic actuator. In particular, the configuration as an electromagnet offers the possibility here to provide an actuator which is favourably priced and is comparatively small in structure, which can be constructed at a favourable cost owing to the only comparatively small forces necessary for cancelling the locked position.

In a further advantageous embodiment of the solution according to the invention, on the first and second engagement element a wedge-shaped ramp is provided respectively laterally for the prestressing of the arresting device, i.e. for the prestressing of the locking element. Through such a wedge-shaped ramp, an adjusting of the respectively associated engagement element from its switching position into its basic position can be utilized simultaneously to prestress the arresting device, so that an actuator is necessary only for releasing the arresting device, but not for bringing in the locking catch or respectively the locking pin. The great advantage here is that only one actuator can be used, which in an energized/activated manner assumes only one position. Thereby, a more expensive linear actuator, which can assume two positions, can be dispensed with. A further advantage lies in the currentless and quick arresting (=arresting phase is the phase with the highest dwell time). For this reason, it is advantageous not to use any energy here. As the actuator is only used for connection triggering and does not undertake the arresting or connecting as such, it is lightly loaded and achieves a high lifespan. Such a wedge-shaped ramp constitutes here a comparatively simple and favourably priced element, by means of which the prestressing of the arresting device is possible reliably and, at the same time, at a favourable cost and with few components.

In a further advantageous embodiment of the solution according to the invention, the cam follower has a roller pin and a roller mounted rotatably thereon, wherein the arresting device is preferably arranged in the roller pin. Hereby, an accommodating of the arresting device in a particularly optimized manner with regard to installation space can be brought about in an installation space which is hitherto unused or respectively is not developed.

Expediently, the first slide guide has the previously described ramp structure, which is configured in such a way that the first engagement element is brought out of engagement with the first slide guide and can thereby be transferred into its basic position. Such a ramp structure can be simply achieved here by a constantly decreasing groove depth of the slide guide. In the same manner, such a ramp structure can of course also be provided at the second slide guide.

The present invention is based in addition on the general idea of equipping an internal combustion engine with the previously described valve train, whereby an internal combustion engine can be created which can change quickly between different operating modes and wherein the components used for this are not only optimized with regard to installation space, but at the same time are also favourably priced.

Further important features and advantages of the invention will emerge from the subclaims, from the drawings and from the associated figure description with the aid of the drawings.

It shall be understood that the features mentioned above and to be explained further below are able to be used not only in the respectively indicated combination, but also in other combinations or in isolation, without departing from the scope of the present invention.

Preferred example embodiments of the invention are illustrated in the drawings and are explained further in the following description, wherein the same reference numbers refer to identical or similar or functionally identical components.

BRIEF DESCRIPTION OF THE DRAWINGS

There are shown, respectively diagrammatically.

DETAILED DESCRIPTION

Figure 1:
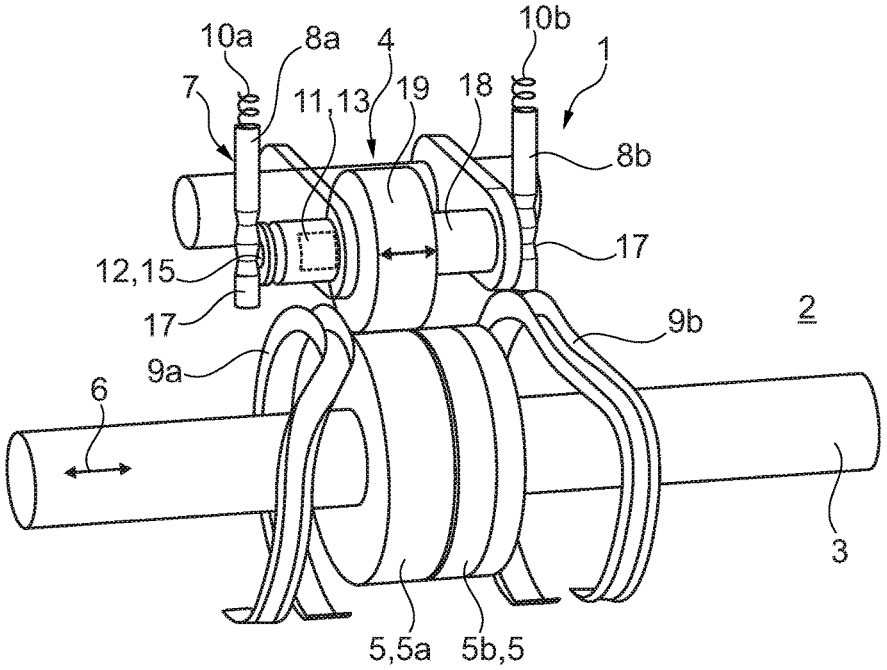
FIG. 1 a valve train according to the invention for an internal combustion engine in an oblique view, FIG. 2 an illustration as in FIG. 1, but with a different adjustment arrangement and in a front view, FIGS. 3, 4 a highly diagrammatic illustration of an adjustment arrangement of different embodiments.
Figure 2:
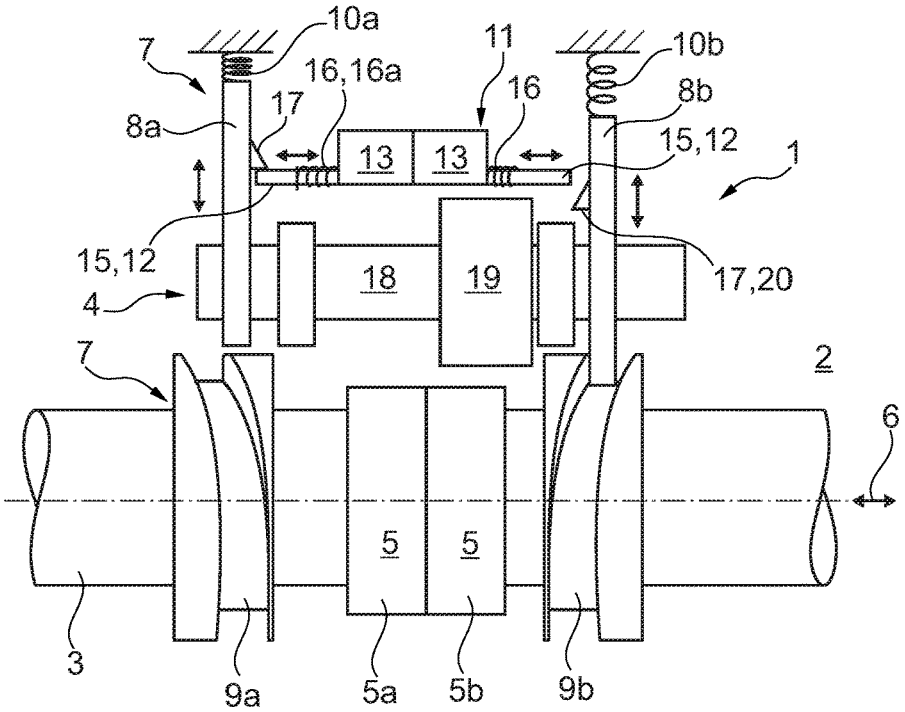

According to FIGS. 1 and 2, a valve train 1 according to the invention for an otherwise only indicated internal combustion engine 2 has a camshaft 3 and a cam follower 4. A first cam 5*a* and a second cam 5*b*, axially adjacent thereto, are arranged here on the camshaft 3 in a torque-proof manner, which cams have different cam profiles. For example, one of the two cams 5*a*, 5*b* can have only a base circle and therefore no cam lobe, so that via this a cylinder disconnection is possible. In order to be able to change between the cam profiles of the two cams 5*a*, 5*b*, the cam follower 4 is axially adjustable, i.e. in relation to the axial direction 6 of the camshaft 3 and namely between a first position, in which it is drivingly or respectively operatively connected with the cam 5*a* (cf. FIG. 1) and a second position, in which it is drivingly or respectively operatively connected with the second cam 5*b* (cf. FIG. 2). An adjustment arrangement 7 is likewise provided for the axial adjustment of the cam follower 4 between the first and the second position, which adjustment arrangement has an adjustable first mechanical engagement element 8*a*, which for the axial adjusting of the cam follower 4 from the first into the second position cooperates with at least a first slide guide 9*a* present on the camshaft 3 or engages therein. Furthermore, the adjustment arrangement 7 has an adjustable second mechanical engagement element 8*b*, which for the axial adjusting of the cam follower 4 from the second back into the first position cooperates with at least a second slide guide 9*b* present at the camshaft 3. The first and the second engagement element 8*a*, 8*b* are adjustable here respectively between a basic position (cf. the position of the engagement element 8*a* in FIG. 1-4), in which there is no contact with the associated slide guide 9*a*, 9*b*, and a switching position (cf. the position of the second engagement element 8*b* in FIGS. 2 to 4), in which the respective engagement element 8*a*, 8*b* cooperates with the associated slide guide 9*a*, 9*b*. The respective engagement element 8*a*, 8*b* can be in one piece here, as is illustrated in FIG. 1, 2 and in the respective engagement element 8*b* of FIGS. 3 and 4, or else in several parts (cf. engagement elements 8*b* in FIGS. 3 and 4). Furthermore, the adjustment arrangement 7 has for each engagement element 8*a*, 8*b* a spring 10*a*, 10*b*, which it prestresses into its switching position. Likewise, an arresting device 11 is provided, which holds the associated engagement element 8*a*, 8*b* in its basic position with a locking element 12 situated in its locked position. This is the case for example according to FIGS. 2 and 3 with the first engagement element 8*a*. Furthermore, an associated actuator 13 is provided for releasing the arresting device 11, i.e. for unlocking the locking element 12 from its locked position (cf. the locking element 12 according to FIGS. 2 and 3, 4 with engagement element 8*b*).

The arresting device 11 can have here as locking element 12 for example a locking catch 14 (cf. FIG. 3, 4) or a locking pin 15 (cf. FIG. 2). The arresting device 11 and in particular its respective locking element 12 are prestressed here by means of a spring 16 into their locked position, as can be clearly seen for example with the locking elements 12 with respect to the first engagement element 8*a* in FIGS. 2 and 3. Here, as spring 16 for example a helical spring 16*a* (cf. FIG. 2) or else a leg spring 16*b* (cf. FIG. 3, 4) can be used. In the configuration of the locking element 12 as locking catch 14, the latter cooperates in the locked position with an associated locking contour 20 (cf. FIG. 3, 4) on the engagement element 8*a*, 8*b*, wherein the locking contour 20 can be configured for example as a groove.

The actuator 13 is preferably configured as an electric actuator, in particular as an electromagnet, as a hydraulic actuator or as a pneumatic actuator, and serves only for releasing the arresting device 11, whereupon the latter draws the respectively associated locking element 12 out from its locked position, so that the associated engagement element 8*a*, 8*b*, owing to the respectively associated spring 10*a*, 10*b*, is abruptly adjusted into its switching position. In addition to the extremely quick switching time, the valve train 1 according to the invention, and in particular also the adjustment arrangement 7 according to the invention, offers the great advantage that it is configured in a structurally extremely simple manner, is accommodated in a space-saving manner and, in addition, is able to be produced at a favourable cost.

Observing FIG. 2 further, it can be seen that on the first and second engagement element 8*a*, 8*b* respectively laterally a wedge-shaped ramp 17 is provided for prestressing the locking element 12. Through the wedge-shaped ramp 17, in particular a second actuator necessary for the drawing back of the respective locking element 12 can be dispensed with here, whereby the variety of parts can be reduced, and thereby also the costs for storage and logistics can be lowered.

A resetting of the respective engagement element 8*a*, 8*b* takes place here via a ramp structure, not designated in further detail, which is arranged in the respectively associated slide guide 9*a*, 9*b* and at the same time is configured in such a way that the first engagement element 8*a* is brought out of engagement with the first slide guide 9*a* and additionally is brought into its basic position. In the same way, the second slide guide 9*b* has a ramp structure, which is configured in such a way that the second engagement element 8*b* is transferred out of engagement with the second slide guide 9*b* and thereby into its basic position.

Alternatively thereto, the returning of the respective engagement element 8*a*, 8*b* can also take place via an adjustment arrangement 22 (cf. FIG. 4 for the engagement element 8*a*), which is operated for example hydraulically, pneumatically, electromagnetically, mechanically or electrically. In this case, the majority of parts of the adjustment arrangement 7 are therefore decoupled from the movement of the cam follower 4.

The cam follower 4 itself usually has a roller pin 18, on which a rotatably mounted roller 19 is arranged. Via this roller 19, the picking up takes place of the cam profile of the cam 5*a*, 5*b* which is respectively passed over. In a particularly preferred embodiment of the valve train 1 according to the invention, the arresting device 11, i.e. in particular the actuators 13 or respectively the locking elements 12, in particular the locking pins 15, is/are arranged in the roller pin 18, whereby an embodiment is possible which is particularly optimized with regard to installation space.

When the switching is triggered in a delayed manner owing to different influencing factors, or for cost reasons a slow/inaccurate actuator 13 is used (slow in relation to the time which is required in order to carry out a crankshaft revolution), it can occur that the engagement element 8*a*, 8*b* can no longer engage into the associated groove of the slide guide 9*a*, 9*b*, which brings it about that the engagement element 8*a*, 8*b* is pushed back into its arresting position, without having carried out the switching process. This can be counteracted by the active actuator 13 only then being deactivated (travels again in locking position), when the cam follower 4 has reached the new position. Thereby, it is ensured that a switching process takes place, even when the switching- and reaction times of the actuator 13 are reduced over its lifetime. This can then also take place only two or three camshaft revolutions later. Here, the moved-out engagement element 8*a*, 8*b* runs on the slide element until it can engage into the slide guide 9*a*, 9*b*. Therefore, slower or more favourable actuators 13 can also be used, because an arresting of the engagement element 13 only begins again after the switching process has been completely terminated.

Figure 3:
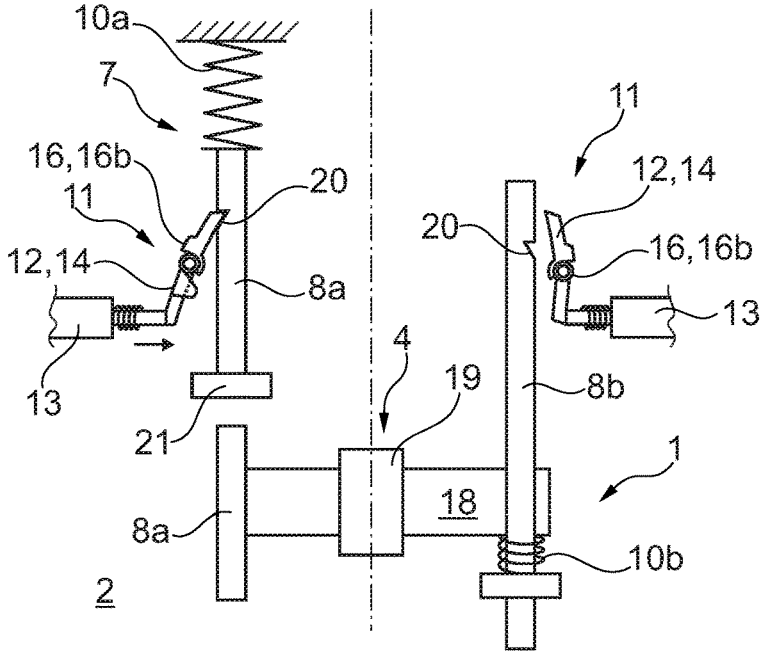
Figure 4:
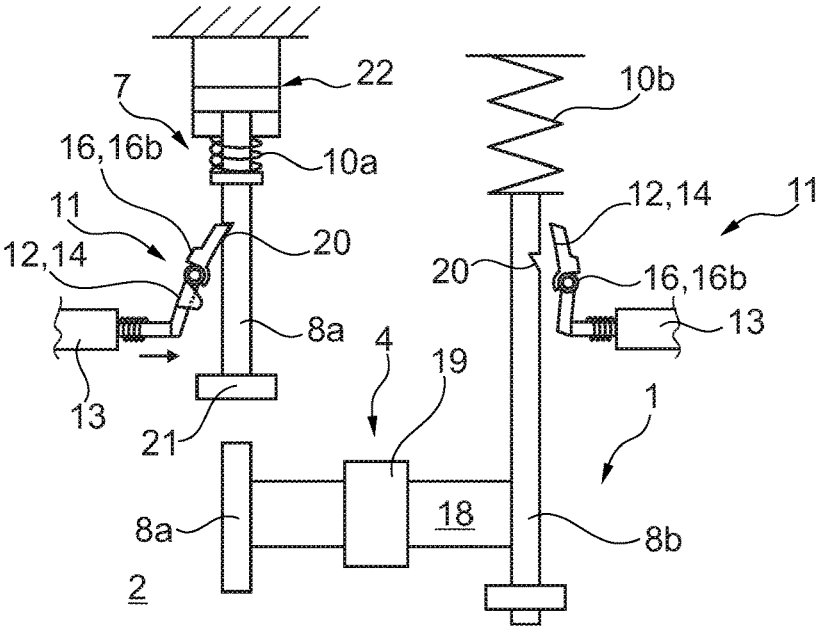

Observing the embodiments of FIG. 3 further, it is noticeable that the spring 10*a* rests on a fixed component of the valve train 1, whereas the spring 10*b* rests on the roller pin 18. It is merely important here that the spring 10*a*, 10*b* prestresses the associated multi-part engagement element 8*a* or the associated single-part engagement element 8*b* into its switching position.

Here, the actuator 13 in the left-hand illustration of FIG. 3 is fixed, and the multi-part engagement element 8*a* has at its upper part such a large plate 21, which can cooperate with the lower part of the engagement element 8*a* irrespective of the axial position of the cam follower 4. Hereby, the number of moving parts can be distinctly reduced. In this case, therefore, the ramp structure in the slide guide 9*a* can bring about the resetting of the associated engagement element 8*a*. The actuator 13 (right-hand illustration in FIG. 3), actuating the engagement element 8*b*, can, but does not necessarily have to, adjust with the cam follower 4 in the axial direction, as also the actuator 13 in FIG. 4, actuating the engagement element 8*b*, in so far as the locking catch 14 is long enough.

With the valve train 1 according to the invention, and the internal combustion engine 2 according to the invention, it is therefore possible to provide a simply constructed and, at the same time, quickly switching valve train 1, which at the same time is able to be produced at a favourable cost.

The invention claimed is:

1. A valve train for an internal combustion engine, the valve train comprising:

a camshaft;

a first slide guide and a second slide guide on the camshaft;

a first cam mounted in a torque-proof manner on the camshaft, and a second cam arranged in a torque-proof manner on the camshaft axially adjacent to the first cam;

a cam follower adjustable between a first position, in which the cam follower is drivingly connected with the first cam, and a second position, in which the cam follower is drivingly connected with the second cam; and an adjustment arrangement configured to axially adjust the cam follower between a first position and a second position, the adjustment arrangement having:

an adjustable mechanical first engagement element configured to axially adjust the cam follower from the first position into the second position, the first engagement element cooperating with at least the first slide guide, the first engagement element being adjustable between a basic position, in which no contact exists with the first slide guide, and a switching position, in which the first engagement element cooperates with the first slide guide, the first engagement element having a spring that prestresses the first engagement element into the switching position; and an adjustable mechanical second engagement element configured to axially adjust the cam follower from the second position into the first position, the second engagement element cooperating with at least the second slide guide, the second engagement element being adjustable between a basic position, in which no contact exists with the second slide guide, and a switching position, in which the second engagement element cooperates with the second slide guide, the second engagement element having a spring that prestresses the second engagement element into the switching position;

wherein each of the first and second engagement elements includes:

an arresting device having an actuator wherein the arresting device, when in a locked position, holds an associated engagement element of the first and second engagement elements in the basic position, and the actuator releases the arresting device; and a wedge-shaped ramp provided laterally such that the associated engagement element prestresses the arresting device.

2. The valve train according to claim 1, wherein each arresting device has a locking element, which in the locked position cooperates with a locking contour on the associated engagement element.

3. The valve train according to claim 2, wherein each arresting device is prestressed into the locked position by a spring.

4. The valve train according to claim 3, wherein each actuator is configured as an electromagnet.

5. The valve train according to claim 2, wherein each locking element is one of a locking catch and a locking pin.

6. The valve train according to claim 2, wherein each locking contour is a groove.

7. The valve train according to claim 2, wherein each actuator is configured as one of an electric actuator, a hydraulic actuator, and a pneumatic actuator.

8. The valve train according to claim 2, wherein each of the first and second engagement elements further includes a laterally provided wedge-shaped ramp configured to prestress the arresting device.

9. The valve train according to claim 2, wherein the cam follower has a roller pin and a roller mounted rotatably on the roller pin.

10. The valve train according to claim 9, wherein each arresting device is arranged in the roller pin.

11. The valve train according to claim 1, wherein each actuator is configured as one of an electric actuator, a hydraulic actuator, and a pneumatic actuator.

12. The valve train according to claim 1, wherein the cam follower has a roller pin and a roller mounted rotatably on the roller pin.

13. The valve train according to claim 12, wherein each arresting device is arranged in the roller pin.

14. The valve train according to claim 1, wherein at least one of:

the first slide guide has a ramp structure, configured such that the first engagement element is brought out of engagement with the first slide guide and into the basic position; and the second slide guide has a ramp structure, configured such that the second engagement element is brought out of engagement with the second slide guide and into the basic position.

15. The valve train according to claim 1, further comprising a second adjustment arrangement configured to return a respective one of the first and second engagement elements.

16. The valve train according to claim 15, wherein the second adjustment arrangement is one of hydraulic, pneumatic, electromagnet, mechanical, and electric.

17. The valve train according to claim 1, wherein at least one of:

the first slide guide has a ramp structure configured such that the first engagement element is brought out of engagement with the first slide guide and into the basic position; and the second slide guide has a ramp structure configured such that the second engagement element is brought out of engagement with the second slide guide and into the basic position.

18. An internal combustion engine comprising:

a valve train having:

a camshaft;

a first slide guide and a second slide guide on the camshaft;

a first cam mounted in a torque-proof manner on the camshaft, and a second cam arranged in a torque-proof manner on the camshaft axially adjacent to the first cam;

a cam follower adjustable between a first position, in which the cam follower is drivingly connected with the first cam, and a second position, in which the cam follower is drivingly connected with the second cam; and an adjustment arrangement configured to axially adjust the cam follower between a first position and a second position, the adjustment arrangement having:

an adjustable mechanical first engagement element configured to axially adjust the cam follower from the first position into the second position, the first engagement element cooperating with at least the first slide guide, the first engagement element being adjustable between a basic position, in which no contact exists with the first slide guide, and a switching position, in which the first engagement element cooperates with the first slide guide, the first engagement element having a spring that prestresses the first engagement element into the switching position; and an adjustable mechanical second engagement element configured to axially adjust the cam follower from the second position into the first position, the second engagement element cooperating with at least the second slide guide, the second engagement element being adjustable between a basic position, in which no contact exists with the second slide guide, and a switching position, in which the second engagement element cooperates with the second slide guide, the second engagement element having a spring that prestresses the second engagement element into the switching position;

wherein each of the first and second engagement elements includes an arresting device having an actuator, wherein the arresting device, when in a locked position, holds an associated engagement element of the first and second engagement element in the basic position, and the actuator releases the arresting device;

wherein the cam follower has a roller pin and a roller mounted rotatably on the roller pin, and each arresting device is arranged in the roller pin.

19. A valve train for an internal combustion engine, the valve train comprising:

a camshaft;

a first slide guide and a second slide guide on the camshaft;

a first cam mounted in a torque-proof manner on the camshaft, and a second cam arranged in a torque-proof manner on the camshaft axially adjacent to the first cam;

a cam follower adjustable between a first position, in which the cam follower is drivingly connected with the first cam, and a second position, in which the cam follower is drivingly connected with the second cam; and an adjustment arrangement configured to axially adjust the cam follower between a first position and a second position, the adjustment arrangement having:

an adjustable mechanical first engagement element configured to axially adjust the cam follower from the first position into the second position, the first engagement element cooperating with at least the first slide guide, the first engagement element being adjustable between a basic position, in which no contact exists with the first slide guide, and a switching position, in which the first engagement element cooperates with the first slide guide, the first engagement element having a spring that prestresses the first engagement element into the switching position; and an adjustable mechanical second engagement element configured to axially adjust the cam follower from the second position into the first position, the second engagement element cooperating with at least the second slide guide, the second engagement element being adjustable between a basic position, in which no contact exists with the second slide guide, and a switching position, in which the second engagement element cooperates with the second slide guide, the second engagement element having a spring that prestresses the second engagement element into the switching position;

wherein each of the first and second engagement elements includes:

an arresting device having an actuator and a spring, the arresting device having one of a locking catch and a locking pin, the spring prestressing the arresting device in a locked position in which the one of the locking catch and the locking pin cooperate with a locking contour on an associated engagement element of the first and second engagement elements to hold the associated engagement element in the basic position, the actuator releasing the arresting device; and a wedge-shaped ramp provided laterally such that the associated engagement element prestresses the arresting device.

* * * * *